United States Patent [19]

Gandelman

[11] 4,321,734

[45] Mar. 30, 1982

[54] CLASP ASSEMBLY

[76] Inventor: Morris D. Gandelman, 212 Duxbury Ct., Warwick, R.I. 02886

[21] Appl. No.: 48,480

[22] Filed: Jun. 14, 1979

[51] Int. Cl.[3] ..... A44B 11/26

[52] U.S. Cl. ..... 24/230 AT; 24/313

[58] Field of Search ..... 24/230 AT, 230 R, 77 R, 24/77 S, 211 M, 313

[56] References Cited

U.S. PATENT DOCUMENTS

| | | | |
|---|---|---|---|
| 1,209,369 | 12/1916 | Wood | 24/230 AT |
| 2,518,889 | 8/1950 | Henderson | 24/230 AT |
| 3,090,092 | 5/1963 | Szemplak et al. | 24/230 AT |
| 3,262,169 | 7/1966 | Jantzen | 24/230 AT |
| 3,605,210 | 9/1971 | Lohr | 24/230 AT |
| 3,789,467 | 2/1974 | Aratani et al. | 24/77 R |

FOREIGN PATENT DOCUMENTS

| | | | |
|---|---|---|---|
| 286603 | 10/1952 | Switzerland | 24/230 AT |

*Primary Examiner*—Alexander Grosz
*Attorney, Agent, or Firm*—Salter & Michaelson

[57] ABSTRACT

A clasp assembly is provided for securing together the free ends of opposed flexible members and includes a first coupling member that is joined to the free end of one of the flexible members and a second coupling member that is joined to the free end of the other flexible member. In the latched position the coupling members appear to be an integral part of the flexible members and impart an ornamental appearance thereto. The first coupling member includes a box element in which a transversely extending spring is located and has a pair of snap levers pivotally mounted on the sides thereof. The second coupling member includes an outwardly extending tongue element that is formed with opposed notches that are engageable with the snap levers for locating the tongue in a latched position within the first coupling member, the snap levers being pivotally movable relative to the tongue and against the action of the spring from a closed to an open position upon the application of a force thereto, for releasing the tongue from engagement with the snap levers and thereby disengaging the coupling members.

14 Claims, 8 Drawing Figures

CLASP ASSEMBLY

BACKGROUND OF THE INVENTION

The present invention relates to a clasp assembly that is used with straps, bands or bracelets and the like and that interconnects the free ends of opposed flexible members for securing the strap, band or bracelet in fastened position on the wrist, arm or around the waist of a user. In this connection, the present invention has application as a clasp for jewelry articles and in addition has application for use as a belt clasp or as a buckle for a safety belt.

One of the preferred uses of the invention is as a clasp for a watch bracelet or the like. Prior to the instant invention, various kinds of clasps have been used for watch bracelet constructions for fastening the bracelet on the wrist of the wearer. In all of the prior known clasps, the clasp which was secured to the ends of the bracelet defined a visibly apparent separate element which somewhat detracted from the ornamental qualities of the bracelet. Further, these prior known bracelet clasps were somewhat difficult to operate in the release of the coupling members when removing the bracelet from the wrist of the wearer, and as a result some special effort had to be devoted to unfastening the coupling members in order to remove the bracelet from the wrist of the wearer. One such prior known clasp construction is illustrated in U.S. Pat. No. 3,795,028.

Although the invention has application as a jewelry clasp, the concepts embodied therein enable it to be used as a clasp for other purpose, and as indicated above, the invention can be utilized as a belt clasp or as a buckle for a safety belt. In this connection the prior art references found to be most pertinent are U.S. Pat. Nos. 3,090,092; 3,262,169; 3,605,210; 3,713,192 and 3,789,467.

SUMMARY OF THE INVENTION

The present invention relates to a clasp assembly for use in interconnecting the free ends of a flexible member such as a band, strap or bracelet and includes a first coupling member joined to the free end of one of the flexible members and a second coupling member joined to the free end of the other flexible member. The first coupling member includes a box element that is joined to the free end of a flexible member, a transversely extending tubular portion being formed interiorly of the box element and receiving a spring therein. A pair of snap levers are pivotally mounted on a side of the box element and are engageable by the spring for being normally urged to a closed position thereby. The second coupling element is joined to the free end of the other flexible member and is formed with an outwardly extending tongue that has opposed notches formed in the sides thereof that are engageable with latch portions of the snap levers for locating the coupling members in a latched and closed position when the tongue is inserted interiorly of the box element of the first coupling member. In this position the coupling members appear to be an integral part of the flexible members and thereby impart the impression of a continuous band. In order to disengage the coupling members the snap levers are pivotally movable relative to the tongue by pressing inwardly on the heels of the snap levers wherein the tongue is released from engagement with the latch portion of the snap levers.

Accordingly, it is an object of the present invention to provide a clasp assembly for use in interconnecting the free ends of a band, strap or bracelet which includes coupling members that are secured to the opposed flexible members of the band, strap or bracelet and that when located in the latched position thereof impart the impression that they are an integral part of the band, strap or bracelet assembly.

Another object of the invention is to provide a clasp assembly that includes a relatively simple latching means that enables the coupling members of the clasp assembly to be easily engaged and disengaged as required.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
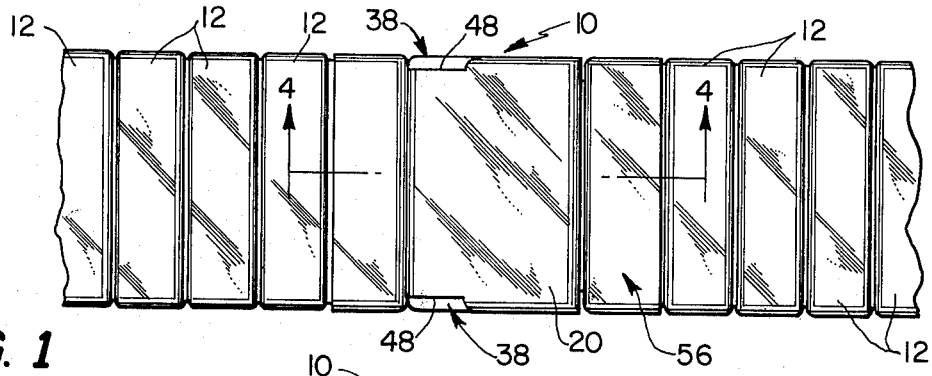
FIG. 1 is a top plan view of the clasp assembly as secured to the free ends of opposed flexible members, such as used in a bracelet construction.
Figure 2:
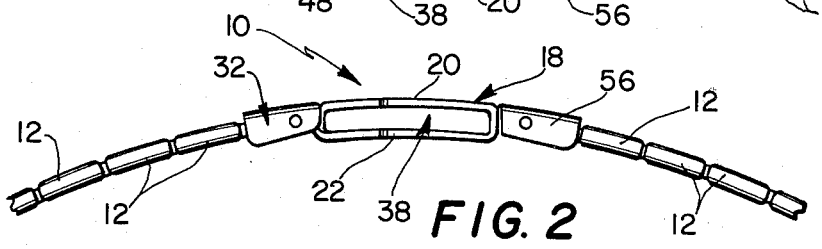
FIG. 2 is a side elevational view of the clasp assembly as illustrated in FIG. 1.

Referring now to the drawings, and particularly to FIGS. 1 and 2, the clasp assembly embodied in the present invention is generally indicated at 10, and as shown, has application for use as a watch bracelet. However, it is also contemplated that the clasp assembly 10 as will be described hereinafter may be utilized to join the free ends of various kinds of flexible members, such as ornamental straps or bands that are used for encirclement of a user's arm, leg, waist or neck; and in addition, it is also contemplated that the clasp assembly 10 be used to join the free ends of flexible members as used in safety belt construction.

As illustrated in FIGS. 1 and 2, the clasp assembly 10 is interconnected to links 12 of a watchband bracelet, the links 12 being interconnected in any conventional manner to provide for flexibility of the watch bracelet when located on the wrist of the wearer. It is understood that any conventional link construction may be utilized with the clasp assembly 10, one end of the assembled link being interconnected to the watch casing and other free ends being connected to the coupling members of the clasp assembly 10 as will now be described.

As shown more clearly in FIGS. 3 through 8, the clasp assembly 10 is defined by a first coupling member 14 which as will be described forms the female part of the clasp, and a second coupling member 16 that is interengageable with the first coupling member 14 and that forms the male part of the clasp. The first coupling member 14 includes a box element generally indicated at 18 that is formed in a one-piece construction that is defined by a top wall 20, a bottom wall 22, a rear wall 24 and a front wall 26. Formed as an integral part of the top wall 20 and bent inwardly with respect thereto and located adjacent to the rear wall 24 is a curved inner wall 28 that defines a tubular portion, the tubular portion extending transversely of the longitudinal axis of the box element 18. Joined to the curved inner wall 28 that defines the tubular portion and projecting forwardly thereof as an extension and located directly beneath the top wall 20 is an inner guide wall 30. The wall 30 is also sufficiently spaced from the bottom wall 22 to define an inner cavity therewith into which a tongue of the second coupling member 16 is inserted for locating the coupling members in the closed or locked position.

Figure 4:
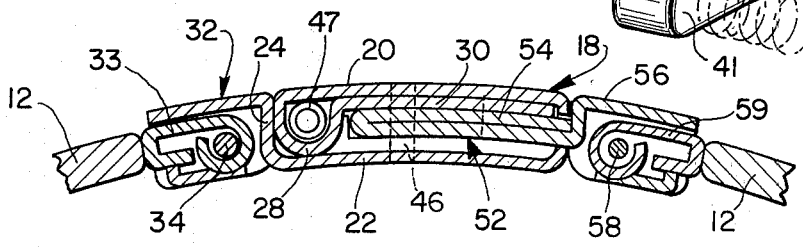
FIG. 4 is a sectional view taken along line 4—4 in FIG. 1.
Figure 8:
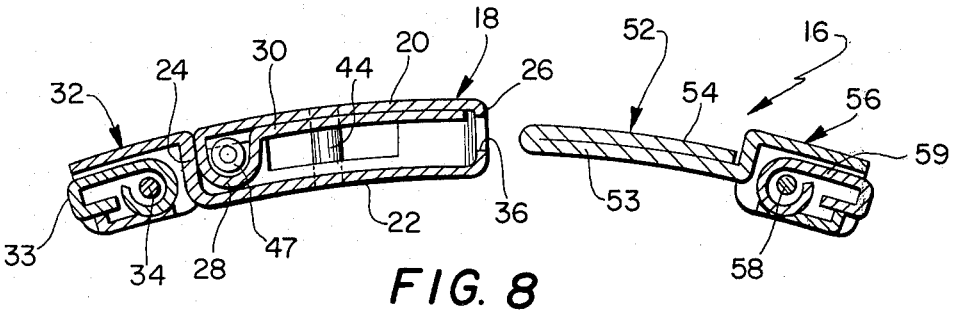
FIG. 8 is a sectional view taken along line 8—8 in FIG. 7.

Also formed as an integral part of the box member 18 and extending rearwardly of the rear wall 24 is an end box generally indicated at 32, shown more clearly in FIGS. 4 and 8. A pin 34 extends through the side walls of the end box 32 and engages an interior portion of a connecting link 33 that interconnects the free end link 12 of the bracelet to the end box 32.

Figure 7:
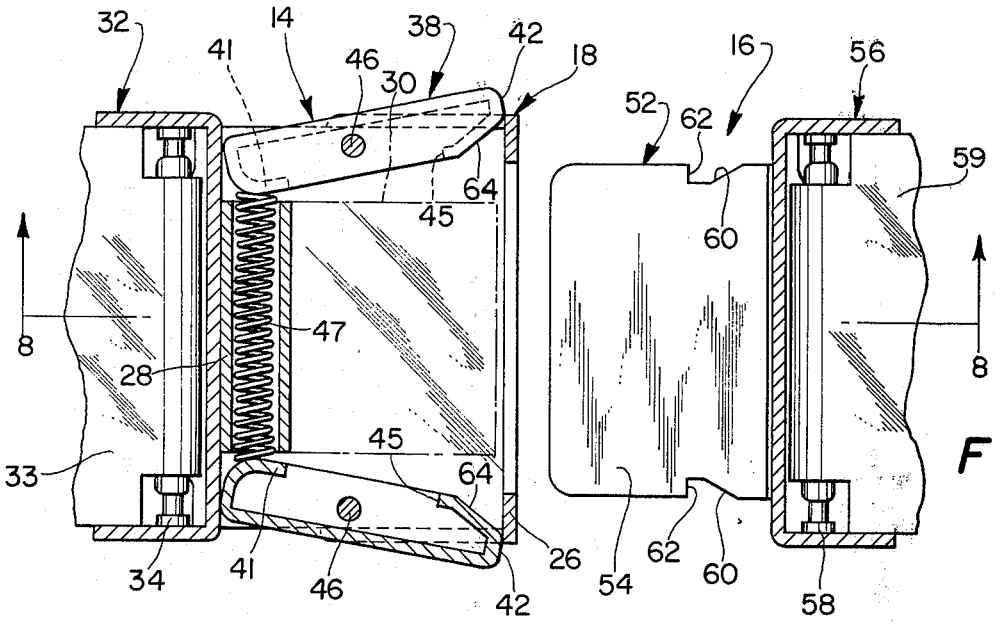
FIG. 7 is a view similar to FIG. 6 but showing the coupling members after the separation thereof.

In order to receive a projecting tongue of the second coupling member 16 when the coupling members are located in the closed or locked position thereof, the front wall 26 of the box element 18 is formed with a slot 36 therein. As shown in FIGS. 7 and 8, the slot 36 communicates with the interior of the box element 18 and provides for access of the projecting tongue of the coupling member 16 therein.

Figure 3:
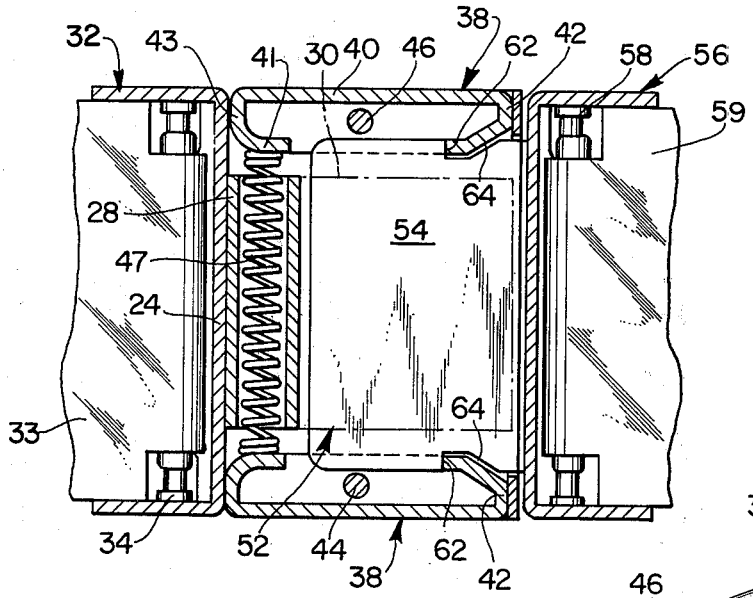
FIG. 3 is a sectional view of the clasp assembly as located in the closed or latched position.
Figure 5:
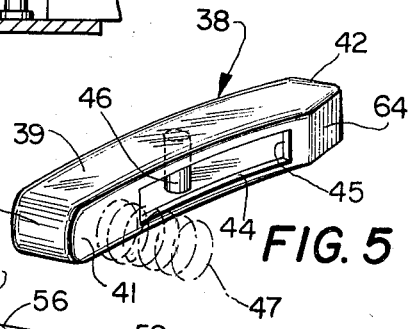
FIG. 5 is a perspective view of one of the snap levers that is secured to a side of the box element of a coupling member of the clasp assembly.

One of the unique features of the invention is providing a positive lock for the coupling members 14 and 16 without the use of the conventional pivoted clasp for joining the ends of the bracelet together. Thus, when the coupling members 14 and 16 are disposed in the locked position thereof as illustrated in FIG. 1, the total effect achieved is that of a continuous link bracelet, rather than the conventional appearance of a pivoted clasp. In order to obtain the ornamental appearance as illustrated in FIG. 1, a pair of snap levers, generally indicated at 38, are provided and are pivotally mounted at the sides of the box element 18 and within the confines thereof between the top wall 20 and bottom wall 22 of the box element 18. One of the snap levers 38 is illustrated more clearly in FIG. 5, and as shown, each of the snap levers 38 is formed hollow in configuration and includes a body portion 39 having an outer wall 40 (FIG. 3) an inner wall 41 and end walls 42 and 43. Formed in the inner wall 41 is a slot 44, the fowardmost edge of which defines a latch portion 45, the purpose of which will hereinafter be described. A pin 46 extends through the walls 20 and 22 of the box element 18 and pivotally locates each of the snap levers 38 in their respective positions within the box element. In order to position the snap levers 38 such that the outer wall 40 thereof is normally aligned with the adjacent walls of the end boxes of the coupling members 14 and 16, a spring 47 is provided, the outermost ends of the spring 47 projecting beyond the ends of the tubular portion and abutting against the rear or heel portion of the inner wall 41 of each snap lever 38. Thus, as illustrated in FIG. 3, in the closed position of the snap levers 38, the spring 47 pivotally urges the snap levers 38 to the aligned location relative to the adjacent end boxes and bracelet links, the end wall 42 of each snap lever in the closed position being located in close adjacent relation to the inner surface of the front wall 26 of the box element 18; and the end wall 43 of the snap levers being disposed in close adjacent relation to the end wall 24 of the box element. As also shown in FIG. 1, the top wall 20 of the box element 18 is cut-away on both sides thereof adjacent to the end box 32 as indicated at 48 to expose the rear end portion of the snap levers 38 to facilitate the depressing thereof when the coupling members are to be released from the latched position.

Referring now to FIGS. 7 and 8 the coupling member 16 is more clearly illustrated and as shown is formed in a one-piece construction that includes a tongue generally indicated at 52 that has a double thickness defined by a projecting portion 53 and a reversely bent portion 54. Integrally joined to the projecting portion 53 of the tongue 52 and extending rearwardly therefrom is an end box generally indicated at 56 that is constructed similarly to the end box 32 and receives a pin 58 therein for pivotally connecting an adjacent link 59 thereto that interconnects the links 12 to the coupling member 16. As shown in FIG. 7, the tongue 52 is also formed with opposed notches 60 that are provided with shoulders 62. The width of the tongue 52 is just slightly less than the width of the slot 36 as formed in the front wall 26 of the box member 18, and the vertical position of the slot 36 in the wall 26 is such as to guide the tongue 52 into the box member 18 so that the reversely bent portion 54 of the tongue slides in contact with the lower surface of the extension 30. By locating the reversely bent portion 54 and the extension 30 in engaging relation, a snug fit is obtained for the tongue 52 in the locked position thereof.

As the tongue 52 is slidably moved within slot 36 into the interior of the box member 18, the sides of the tongue engage the forward portion of the wall 41 of the snap levers to slightly pivot the snap levers outwardly against the action of the spring 47. When the tongue is fully received within the box element 18, the sides of the tongue are received in the slot 44 of the snap levers as shown in FIG. 2 and the spring 47 urges the snap levers 38 to the closed position, wherein the latch portions 45 are located in engaging relation with the shoulders 62 of the tongue. As further shown in FIG. 2, the forward or head end of the front wall 41 of the snap levers is formed with a configuration that corresponds to the configuration of the notch 60, which enables the snap levers 38 to be moved to the latched and aligned position.

In order to prevent the snap levers 38 from being pivotally urged to an over balanced position by the spring 47 and to insure that the tongue 52 is received in the box element 18, the extension 30 is located such that it acts as a stop for the snap levers. In this connection, the head ends of the snap levers strike the outer sides of the extension to prevent the head ends of the snap levers from moving too far inwardly of the box element interior.

The snap levers 38 are also formed with inclined surfaces 64 on the head ends thereof, the inclined surfaces 64 being spaced apart and cooperating to define lead-in surfaces for engagement by the outermost ends of the tongue 52 when it is inserted into the box element 38. Since the surfaces 64 are inclined, the head of the tongue 52 as it enters the slot 36 strikes the surfaces 64 and pivots the snap levers 38 to their normal position, the spring 47 further acting to urge the snap levers 38 into the locked position. As shown in FIG. 3, the tongue 52 is located in the locked position within the box member 18, the snap levers 38 preventing withdrawal of the tongue by interengagement of the latch portions 45 with the shoulders 62 of the tongue.

Figure 6:
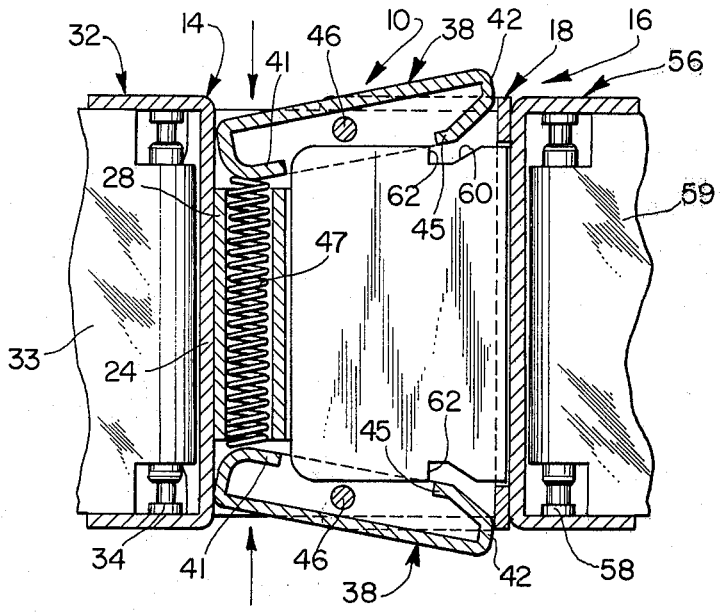
FIG. 6 is a view similar to FIG. 3 but illustrating the position of the snap levers when moved to the open position for releasing the fastened coupling members.

When it is desired to release the coupling members 14 and 16 from their locked and engaged position, the rear portions of the snap levers 38 are pressed inwardly to pivot the snap levers against the action of the spring 47 to locate the snap levers in the position shown in FIGS. 6 and 7. The latch portions 45 of the snap levers 38 are now free of the notches 60 of the tongue 52, and the tongue can be easily withdrawn from the interior of the box member 18.

It is seen that the coupling members 14 and 16 are quickly and simply located in the locked position by merely inserting the tongue 52 within the slot 36 of the box element 18 until the snap levers 38 snap into locking engagement with the tongue. In the locked position as illustrated in FIGS. 1 and 2, the clasp assembly appears to be formed as a part of the bracelet links, and therefore imparts an ornamental and pleasing appearance to the complete bracelet construction. Release of the coupling members from the locked position is also easily accomplished by pressing the rear or heel portions of the snap levers 38 inwardly against the action of the spring 47. Coupling of the coupling members 14 and 16 is easily accomplished with a single hand, if the bracelet is mounted on the wrist of the wearer; and similarly, release of the coupling members is also accomplished with one hand of the user by simply squeezing inwardly on the snap levers 38.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A clasp assembly for securing together the free ends of opposed flexible members, comprising a first coupling member joined to the free end of one of said flexible members and a second coupling member joined to the free end of the other flexible member, said first coupling member including a box element having a top wall and a bottom wall interconnected to said top wall and spaced therefrom, a transversely extending tubular portion located in said box element between said top and bottom walls and formed as an integral extension of said top wall, a spring received in said tubular portion and projecting outwardly of the ends thereof, a pair of snap levers, each of which is pivotally mounted on a side of said box element, each of said snap levers having an interiorly located opening that defines a latch portion thereon, an interior portion of each snap lever being engageable by said spring, wherein said snap levers are normally urged to a locking position, each snap lever having an outer wall that defines a side wall of said first coupling member and that is aligned with the adjacent sides of said flexible members to impart a similar appearance thereto, said second coupling member including an outwardly extending tongue that is formed with opposed notches that are engageable with the latch portions of said snap levers upon insertion of said tongue interiorly of the box element of said first coupling member to releasably secure said second coupling member to said first coupling member in a locked position, said snap levers being pivotally movable relative to said tongue against the action of said spring from the locked to an open position upon the application of a force thereto, wherein said tongue is released from engagement with said snap levers, for disengaging said coupling members.

2. A clasp assembly as claimed in claim 1, said box element of said first coupling member further including a front wall and a rear wall, said front wall having a slot formed therein that communicates with the interior of said box element and receiving said tongue of said second coupling member therein when said tongue is moved to the locked position thereof interiorly of said box element.

3. A clasp assembly as claimed in claim 2, said first coupling member further including a first end box formed as an integral extension of the rear wall of said box element and being secured to the free end of said one flexible member, and means for securing the free end of said one flexible member interiorly of said first end box.

4. A clasp assembly as claimed in claim 3, the opening as formed in each of said snap lever being defined as a slot that communicates with the interior of said box element, the edge of the slot in each snap lever defining the latch portion that engages a notch in said tongue for retaining the tongue in the locked position in said box element.

5. A clasp assembly as claimed in claim 2, pin means extending through said snap levers for securement thereof to the top and bottom walls of said box element in pivotal relation, wherein the rotational axis of said snap levers is perpendicular to said top and bottom walls.

6. A clasp assembly as claimed in claim 2, the box element of said first coupling member being formed in a one-piece construction.

7. A clasp assembly as claimed in claim 1, said tongue having a reversely bent portion to provide for increased strength thereof.

8. A clasp assembly as claimed in claim 1, each of said snap levers having a longitudinally extending slot formed in a side wall thereof, the forward edge of said longitudinally extending slot defining the latch portion of said snap levers.

9. A clasp assembly for securing together the free ends of opposed flexible members, comprising a first coupling member joined to the free end of one of said flexible members and a second coupling member joined to the free end of the other flexible member, said first coupling member including a box element having a top wall and a bottom wall interconnected to said top wall and spaced therefrom, a transversely extending tubular portion located in said box element between said top and bottom walls and formed as an integral extension of said top wall, a spring means located in said tubular portion, a pair of snap levers, each of which is pivotally mounted within a side of said box element and being formed with a latch portion thereon, each snap lever having an outer wall that defines a side wall of said first coupling member and that is aligned with the adjacent sides of said flexible members to impart a similar appearance thereto, said snap levers being engageable by said spring means so as to be normally urged to a locking position, means located interiorly of said box element and spaced from the sides thereof for normally engaging said snap levers and defining an interior stop therefor, said second coupling member including an outwardly extending tongue that is formed with opposed notches that are engageable with the latch portions of said snap levers upon insertion of said tongue interiorly of the box element of said first coupling member to releasably secure said second coupling member to said first coupling member in a locked position, said snap levers being pivotally movable relative to said tongue against the action of said spring means from the locked to an open position upon application of a force thereto, wherein said tongue is released from engagement with said snap levers for disengaging said coupling members.

10. A clasp assembly as claimed in claim 9, said spring means extending outwardly beyond the ends of said tubular portion for engagement with said snap levers.

11. A clasp assembly as claimed in claim 9, each of said snap levers including a head portion having an inclined surface, the inclined surfaces on the head portions of said snap levers being spaced apart and defining a lead-in for directing the tongue into said box element when it is to be inserted therein.

12. A clasp assembly for securing together the free ends of opposed flexible members, comprising a first coupling member joined to the free end of one of said flexible members and a second coupling member joined to the free end of the other flexible member, said first coupling member including a box element in which spring means are located, a pair of snap levers, each of which is pivotally mounted within a side of said box element and being formed with a latch portion thereon, said snap levers being engageable by said spring means so as to be normally urged to a locking position, means located interiorly of said box element and spaced from the sides thereof for engaging said snap levers and defining an interior stop therefore, said second coupling member including an outwardly extending tongue that is formed with opposed notches that are engageable with the latch portions of said snap levers upon insertion of said tongue interiorly of the box element of said first coupling member to releasably secure said second coupling member to said first coupling member in a locked position, said snap levers being pivotally movable relative to said tongue against the action of said spring means from the locked to an open position upon application of a force thereto, wherein said tongue is released from engagement with said snap levers for disengaging said coupling members, said interior stop being defined by a flat extension located within said box element and disposed in parallel relation to the top wall of said box element, the width of said extension being less than the width of said box element so as to provide for accommodation of said snap levers within the sides of said box element.

13. A clasp assembly for securing together the free ends of opposed flexible members, comprising a first coupling member joined to the free end of one of said flexible members and a second coupling member joined to the free end of the other flexible member, said first coupling member including a box element in which spring means are located, a pair of snap levers, each of which is pivotally mounted within a side of said box element and being formed with a latch portion thereon, said snap levers being engageable by said spring means so as to be normally urged to a locking position, means located interiorly of said box element and spaced from the sides thereof for engaging said snap levers and defining an interior stop therefor, said second coupling member including an outwardly extending tongue that is formed with opposed notches that are engageable with the latch portions of said snap levers upon insertion of said tongue interiorly of the box element of said first coupling member to releasably secure said second coupling member to said first coupling member in a locked position, said snap levers being pivotally movable relative to said tongue against the action of said spring means from the locked to an open position upon application of a force thereto, wherein said tongue is released from engagement with said snap levers for disengaging said coupling members, a transversely extending tubular portion formed in said box element for receiving said spring means therein, said spring means extending outwardly beyond the ends of said tubular portion for engagement with said snap levers, said tubular portion having an extension joined thereon, the sides of said extension being engageable by said snap levers to define said interior stop for said snap levers.

14. A clasp assembly for securing together the free ends of opposed flexible members, comprising a first coupling member joined to the free end of one of said flexible members and a second coupling member joined to the free end of the other flexible member, said first coupling member including a box element in which a transversely extending tubular portion is located, a spring received in said tubular portion and projecting outwardly of the ends thereof, a pair of snap levers, each of which is pivotally mounted on a side of said box element, each of said snap levers having an interiorly located opening that defines a latch portion thereon, an interior portion of each snap lever being engageable by said spring, wherein said snap levers are normally urged to a locking position, each snap lever having an outer wall that defines a side wall of said first coupling member and that is aligned with the adjacent sides of said flexible members to impart a similar appearance thereto, said second coupling member including an outwardly extending tongue that is formed with opposed notches that are engageable with the latch portions of said snap levers upon insertion of said tongue interiorly of the box element of said first coupling member to releasably secure said second coupling member to said first coupling member in a locked position, said snap levers being pivotally movable relative to said tongue against the action of said spring from the locked to an open position upon the application of a force thereto, wherein said tongue is released from engagement with said snap levers, for disengaging said coupling members, said box element of said first coupling member being formed with a top wall, a bottom wall, a front wall and rear wall, said front wall having a slot formed therein that communicates with the interior of said box element and receiving said tongue of said second coupling member therein when said tongue is moved to the locked position thereof interiorly of said box element, the box element of said first coupling member being formed in a one-piece construction, said one-piece box element defining said tubular portion as located between the top and bottom walls thereof, said box element further including an extension integrally joined to said tubular portion and located beneath said top wall, said extension forming a guiding surface for said tongue when it is inserted through said slot and interiorly of said box element.

* * * * *